US007225955B2

(12) United States Patent
Yamamoto

(10) Patent No.: US 7,225,955 B2
(45) Date of Patent: Jun. 5, 2007

(54) WATCHBAND AND WATCH

(75) Inventor: Akio Yamamoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 559 days.

(21) Appl. No.: 10/792,904

(22) Filed: Mar. 5, 2004

(65) Prior Publication Data

US 2005/0045677 A1 Mar. 3, 2005

(30) Foreign Application Priority Data

Mar. 6, 2003 (JP) ..... 2003-059787

(51) Int. Cl.
*A44C 5/10* (2006.01)
*A44C 5/02* (2006.01)

(52) U.S. Cl. ..... 224/164; 368/282

(58) Field of Classification Search ..... 224/164, 224/175, 178, 179, 180; 368/282, 280
See application file for complete search history.

(56) References Cited

U.S. PATENT DOCUMENTS 5,038,557 A 8/1991 Otsuki et al.
6,488,404 B2 * 12/2002 Zurcher et al. ..... 368/282
2002/0020726 A1 * 2/2002 Gunster et al. ..... 224/179

FOREIGN PATENT DOCUMENTS

| | | | | |
|---|---|---|---|---|
| CH | 676781 | A5 | * | 3/1991 |
| EP | 1048240 | A1 | | 11/2000 |
| EP | 1048240 | A1 | * | 11/2000 |
| GB | 2227155 | A | | 7/1990 |
| JP | 02-033616 | U | | 3/1990 |
| JP | 2002095507 | A | * | 4/2002 |
| WO | WO-89/08997 | A | | 10/1989 |

* cited by examiner

*Primary Examiner*—Nathan J. Newhouse
*Assistant Examiner*—Jack Morgan
(74) *Attorney, Agent, or Firm*—Global IP Counselors, LLP

(57) ABSTRACT

There is provided a watchband connected to a watch main body. The watchband has a first block, a second block, a connecting pin, an end piece, and a fixing pin. The first block has a first bridge with a first pinhole, and a clamping member disposed in the first pinhole. The second block has a holder that is disposed parallel to the first bridge and has a blind hole, and a second bridge having a second pinhole. The connecting pin extends from the blind hole to the first pinhole and is held with a specific clamping force by the clamping member. The end piece is disposed parallel to the second bridge and is adjacent to the watch main body. The fixing pin extends from the second pinhole to the end piece and connects the second block with the end piece.

18 Claims, 7 Drawing Sheets

WATCHBAND AND WATCH

BACKGROUND OF THE INVENTION

1. Field of the Invention

The present invention relates to a watchband and a watch, and particularly relates to a watchband and watch wherein a plurality of blocks is connected by pins.

2. Background Information

Bands for watches are commonly known wherein the holder of a block comes in contact with the bridge of another block. These blocks are disposed in continuous fashion along the two edges of a band. One end of a connecting pin is connected to one block having a holder. The other end is inserted into a blind hole of another block having a holder through a pinhole in the bridge of the block. The blocks are sequentially connected to each other, and the block connected to an end piece is connected to the end piece by a fixing pin at the connection section of the end piece (see Japanese Utility Model Laid-open Application No. 2-33616).

In such a configuration, if tools are used, for example, to release the fixing pin and to disengage the connection between the end piece and the block, the connection between the block and another block can be easily disengaged without using special tools because the connection is made using a connecting pin. Therefore, the operation of assembling the band or adjusting the length of the band can be performed in an extremely simple manner.

However, in a conventional configuration, the other end of the connecting pin for connecting the blocks to each other is loosely fitted in the blind hole of a block having a holder, so when the watchband is lifted up while the block with the blind hole faces downward in a state in which the fixing pin has been released as described above with the use of tools, for example, problems have been encountered in that the blocks having a blind hole come off the other end of the connecting pin, and the blocks come loose.

It will be clear to those skilled in the art from the disclosure of the present invention that an improved watchband is necessary because of the above-mentioned considerations. The present invention meets the requirements of these conventional technologies as well as other requirements, which will be apparent to those skilled in the art from the disclosure hereinbelow.

SUMMARY OF THE INVENTION

An object of the present invention is to provide a watchband and watch wherein the operation of assembling the band, or the operation of adjusting the length of the band, can be easily performed.

The watchband relating to the present invention is connected to the main body of a watch. This watchband has a first block, a second block, a connecting pin, an end piece, and a fixing pin. The first block has a first bridge with a first pinhole, and a clamping member disposed in the first pinhole. The second block has a holder that is disposed parallel to the first bridge and has a blind hole, and a second bridge having a second pinhole. The connecting pin extends from the blind hole to the first pinhole, and is held with a specific clamping force by the clamping member. The end piece is disposed parallel to the second bridge. The fixing pin extends from the second pinhole to the end piece and connects the second block with the end piece.

The watch relating to the present invention includes the watchband and a watch main body connected to the watchband.

Another watchband relating to the present invention includes a first block, a second block, a first intermediate pin, a third block, a fourth block, a second intermediate pin, a connecting pin, an end piece, and a fixing pin. The first block includes a first bridge having a first pinhole. The second block is disposed parallel to the first block and has a first blind hole and a first clamping member disposed in the first blind hole. The first intermediate pin extends from the first block to the second block and is held with a specific clamping force by the first clamping member. The third block includes a second bridge having a second pinhole. The fourth block is disposed parallel to the third block, and has a second blind hole and a second clamping member disposed in the second blind hole. The second intermediate block extends from the third block to the fourth block and is held with a specific clamping force by the second clamping member. The connecting pin extends from the third block to the fourth block and passes through the first pinhole. The end piece is disposed parallel to the second bridge. The fixing pin extends from the second pinhole to the end piece and connects the third block with the end piece.

Another watch relating to the present invention includes this watchband and a watch main body connected to the watchband.

The objectives, characteristics, merits, and other attributes of the present invention described above shall be clear to those skilled in the art from the description of the invention hereinbelow. The description of the invention and the accompanying diagrams disclose the preferred embodiments of the present invention.

BRIEF DESCRIPTION OF THE DRAWINGS

Referring to the accompanying diagrams, which partially disclose the present invention.

DETAILED DESCRIPTION OF THE PREFERRED EMBODIMENTS

Embodiments of the present invention will now be described with reference to the drawings. As will be apparent from the disclosure of the present invention to those skilled in the art, the description of the invention embodiments is intended solely to illustrate the present invention and should not be construed as limiting the scope of the present invention, which is defined by the claims described below or by equivalent claims thereof.

The preferred embodiments of the present invention will now be described with reference to the drawings.

Figure 1:
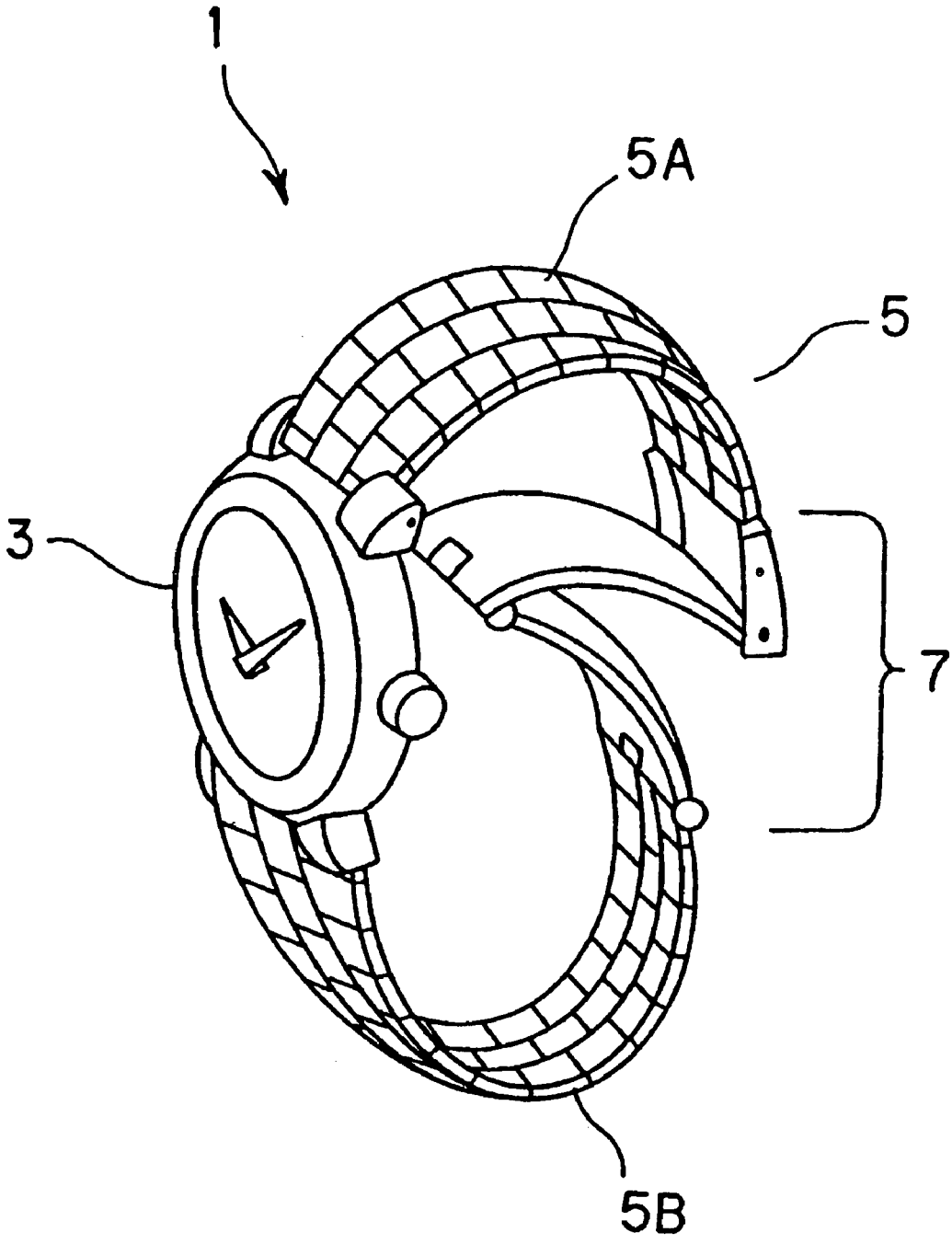
FIG. 1 is a perspective view showing one embodiment of a watch relating to the present invention.

FIG. 1 is a diagram showing the external configuration of the watch relating to the embodiments of the present invention. This watch 1 is configured from a watch main body 3 for displaying the time, and a band 5 connected to the watch main body 3. The watch main body 3 is configured with a time display section accommodated in a metallic case formed from stainless steel, titanium, or the like.

A watch that displays the time in analog fashion is given as an example in the present embodiment, but a watch that displays the time in digital fashion may also be used.

The band 5 is configured by connecting a plurality of blocks formed from stainless steel, titanium, or another such metallic material. The band 5 has an upper band 5A and a lower band 5B, and the upper band 5A and lower band 5B are joined by a clasp (joining section) 7 so as to retain the watch 1 in its mounted position (on the wrist of the user).

Figure 2A:
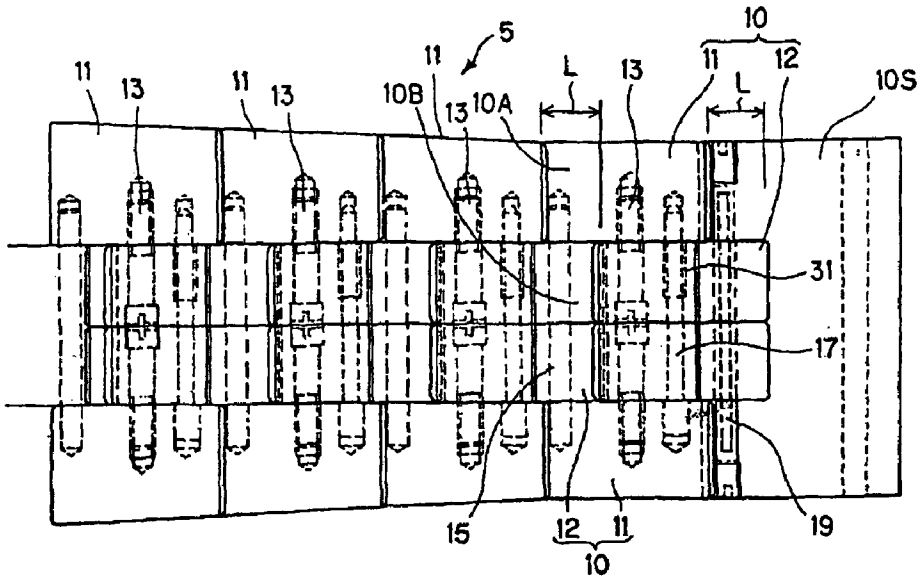
FIG. 2A is a plan view of a band.
Figure 2B:
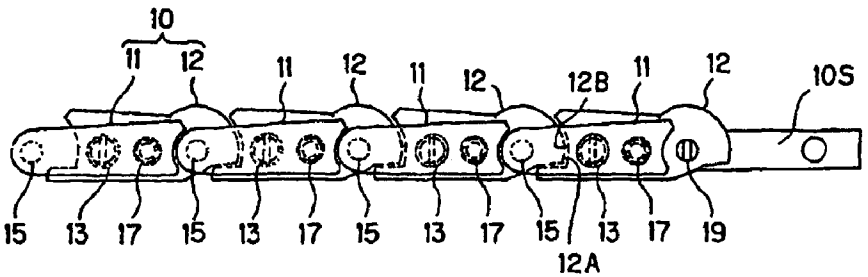
FIG. 2B is a side view of a band.

FIG. 2A is a plan view showing the band 5 of the watch 1, and FIG. 2B is a side view of the same. The upper band 5A and the lower band 5B have substantially the same configuration.

The band 5 is configured by connecting a plurality of blocks 10 formed from stainless steel, titanium, or another such metallic material, as described above.

Figure 3:
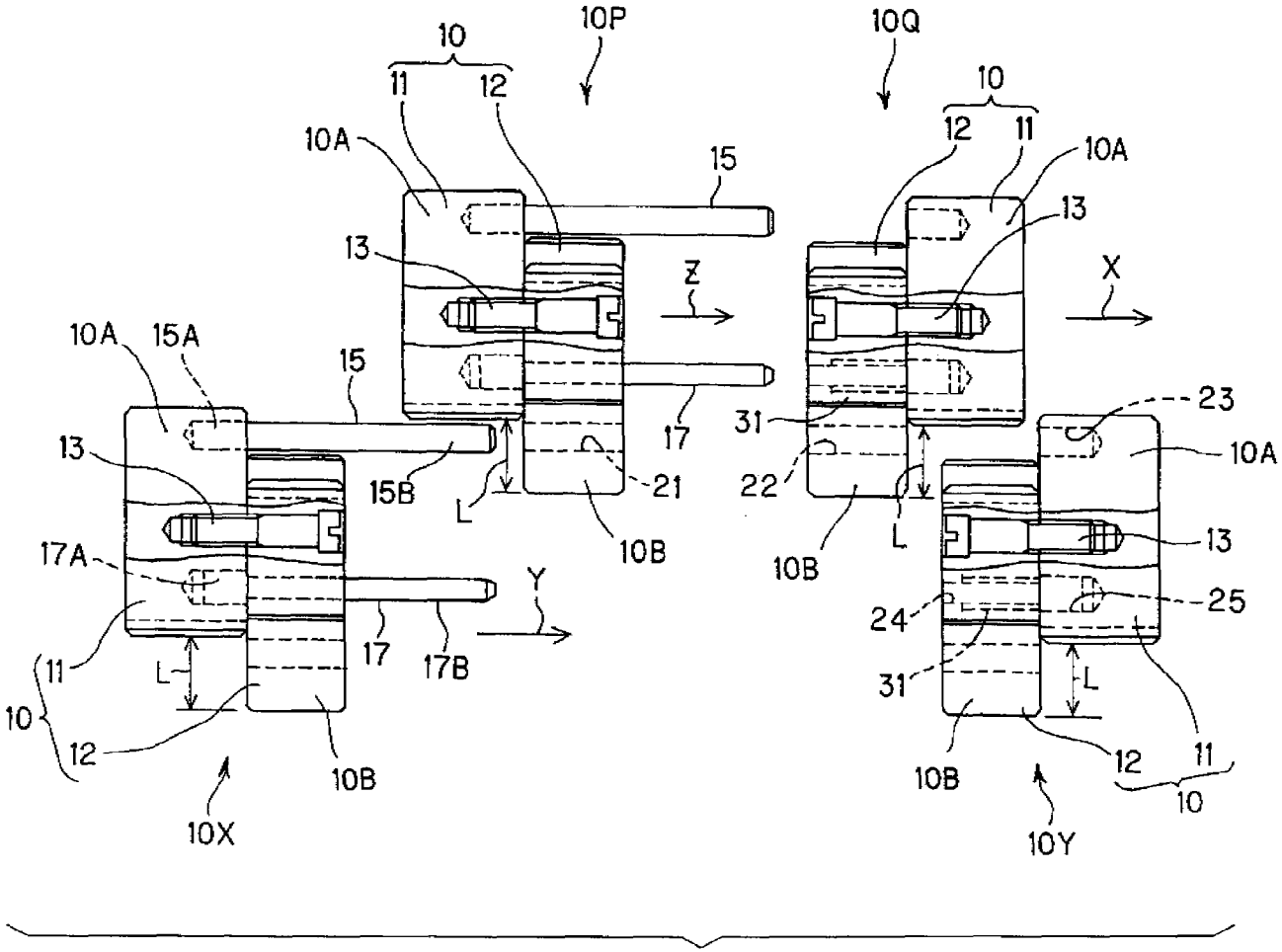
FIG. 3 is a diagram for describing a method of connecting blocks.

These blocks 10 have an outer block 11 and a middle block 12, and are configured by connecting the outer and middle blocks with a screw 13 while they are misaligned in the length direction of the band 5 by a specific dimension L, as shown in FIG. 3. According to this configuration, a holder 10A and a bridge 10B are formed on a block 10.

In the present embodiment, the holder 10A of a block 10 is in contact with the bridge 10B of another block 10, the holder 10A of this other block 10 is then in contact with the bridge 10B of another block 10, and these blocks 10 are disposed in continuous fashion along the two edges of the band 5. Part of the outer block 11 constitutes the holder 10A, and part of the middle block 12 constitutes the bridge 10B.

A convexity 12A is formed on the tip of the middle block 12 constituting the bridge 10B as shown in FIG. 2B, and a concavity 12B facing the convexity 12A is formed on the tip of the adjacent middle block 12. Due to this facing arrangement of concavities and convexities, the blocks 10 form a continuous arrangement without any gaps in the length direction of the band 5 when the band is viewed in a plane.

The blocks 10 disposed along the edges of the band 5 opposite each other are connected by a connecting pin 15 and an intermediate pin 17.

One end 15A of the connecting pin 15 is firmly connected by press fitting to the outer block 11 of a block 10X, and another end 15B is passed through pinholes 21 and 22 formed in the bridges 10B of two blocks 10P and 10Q, and is then inserted into a blind hole 23 formed in the outer block 11 of another block 10Y. The intermediate pin 17 has a head 17A. The head 17A of the intermediate pin 17 is inserted and connected to the outer block 11 and middle block 12 of one block 10X, and the other end 17B thereof is passed through a hole 24 formed in the middle block 12 of another block 10Y, and is further extended and accommodated in the blind hole 25 formed in the outer block 11.

In the present embodiment, a C ring (clamping member) 31 for holding the other end 17B of the intermediate pin 17 with a specific clamping force is provided to the inner side of the hole (integrated with the blind hole 25) 24 formed in the middle block 12 of the other block 10Y.

The clamping force of the C ring 31 is set at least to a strength at which the other block 10Y is not removed by its own weight. For example, when the weight of the entire block 10Y is about 0.098 N, the clamping force is sufficient at 0.49 N and may be greater. However, the weight should be set at 0.98 to 5.88 N with consideration for ease of assembly, disassembly, and the like.

Figure 4:
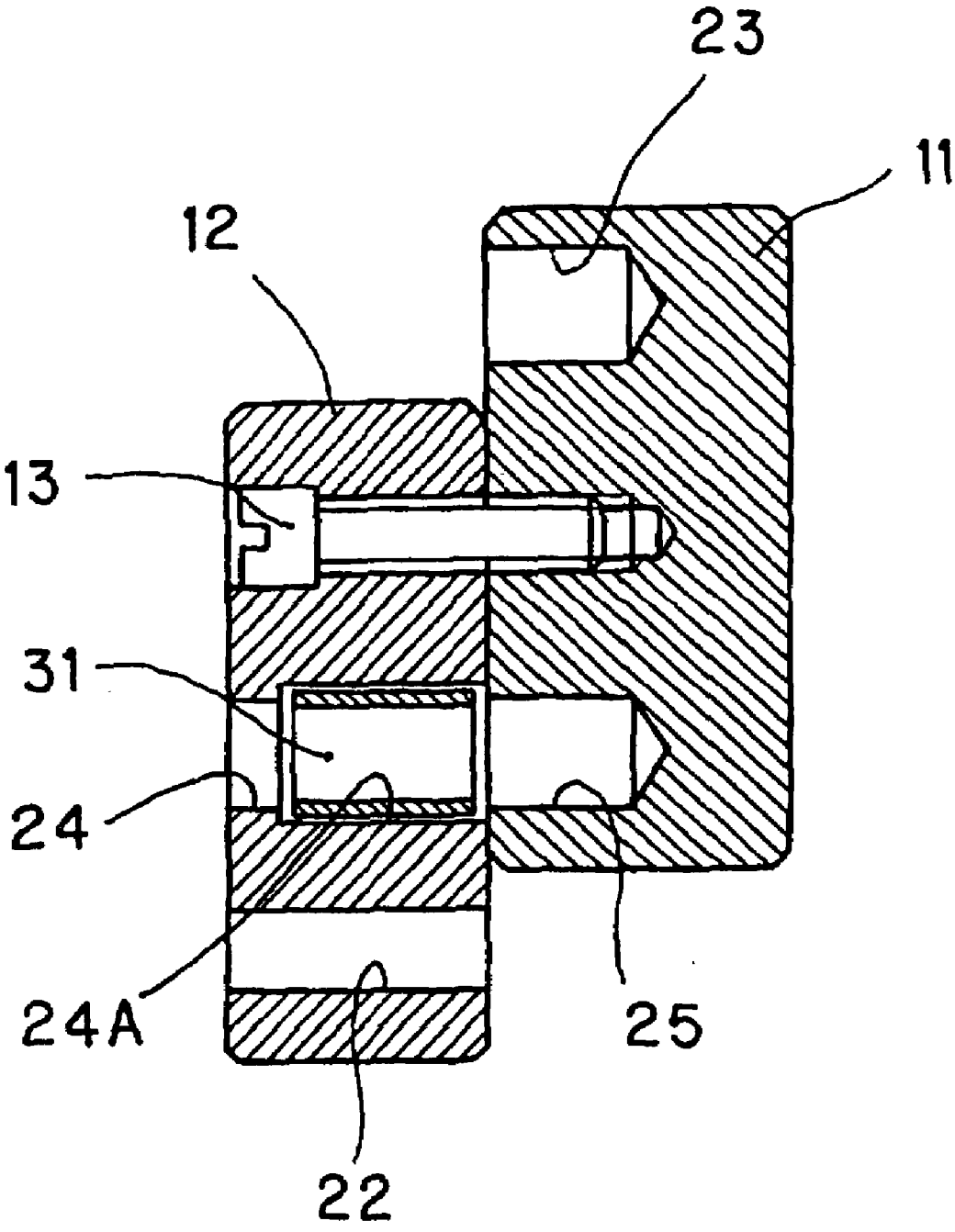
FIG. 4 is a horizontal cross-sectional view of a block.

The C ring 31 is placed into the hole 24, as shown in FIG. 4, before the outer block 11 and middle block 12 of the other block 10Y are connected by a screw 13. This hole 24 has a large radial section 24A in the middle, the C ring 31 is placed in this large radial section 24A, and then the outer block 11 and middle block 12 are connected by the screw 13. Thus, the C ring 31 is prevented from coming out of the hole 24.

Figure 5A:
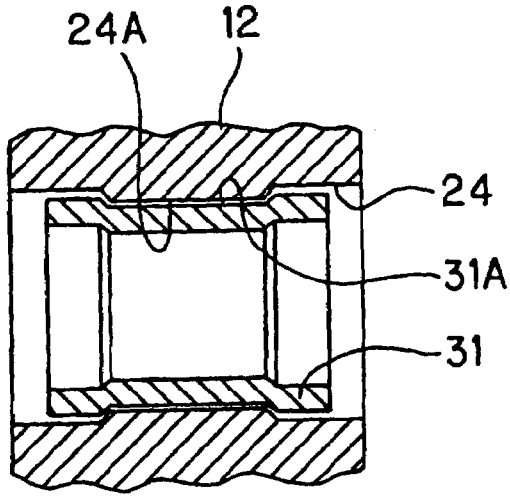
FIG. 5A is a horizontal cross-sectional view of a clamping member.
Figure 5B:
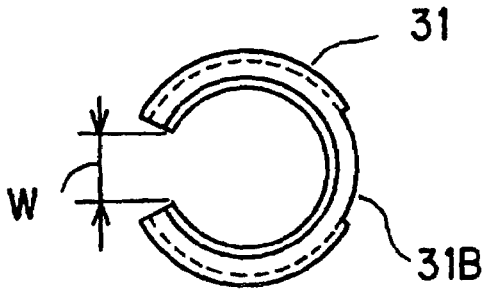
FIG. 5B is a side view of the clamping member.
Figure 5C:
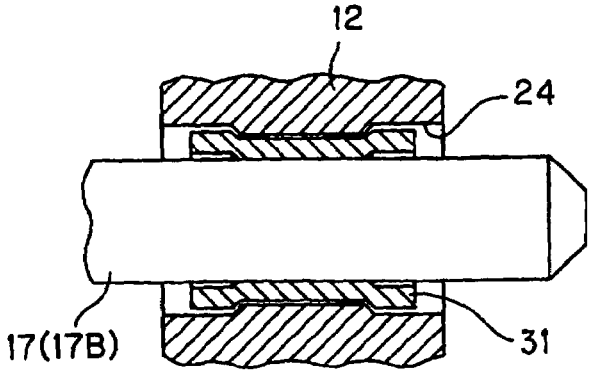
FIG. 5C is a horizontal cross-sectional view showing the clamping member and a pin.

A groove 31A may be formed in the periphery of the C ring 31 as shown in FIGS. 5A through 5C to prevent the ring from coming out. Specifically, a protrusion 24A extending in the peripheral direction is formed in the inner wall of the hole 24 as shown in FIG. 5A, and the C ring 31 is held in the hole 24 by engagement between the protrusion 24A and the groove 31A formed in the periphery of the C ring 31. The C ring 31 has a notch with a large width W and a thin-walled section 31B formed on the opposite side of the notch, and is formed so as to be inserted into the hole 24 and be held there in a state in which the C ring 31 is significantly contracted in the radial direction, as shown in FIG. 5B.

The other end 17B of the intermediate pin 17 is then clamped by the C ring 31 held in the hole 24, as shown in FIG. 5C.

The C ring 31 is disposed in the hole 24 in the embodiment described above, but is not limited to this configuration and may, for example, be disposed in the blind hole 23 accommodating the other end 15B of the connecting pin 15, or may be disposed both in the hole 24 and in the blind hole 23.

The band 5 can be easily assembled or adjusted to the desired length.

Referring to FIG. 3, when the band 5 is being assembled, first the block 10Q is moved in the direction of the arrow X without moving the block 10Y in the right-hand row of the diagram, and the bridge 10B of the block 10Q is placed on the holder 10A of the block 10Y. The block 10X and the block 10P on the left hand side of the diagram are then moved in the direction of the arrows Y and Z, and the other ends 15B and 17B of the connecting pin 15 and intermediate pin 17 of the block 10X and block 10P are inserted into the blind holes of the opposing blocks 10Y and Q to connect the blocks 10P, Q, X, and Y. Though omitted from the diagram, blocks 10 adjacent to the blocks 10P and Q are connected in sequence therebetween.

All the blocks 10 constituting the necessary band length are connected in sequence in the length direction of the band 5 according to the procedure described above, and when this procedure is complete, an end piece 10S is connected to the block 10 at the end of the band 5 by a fixing pin 19, as shown in FIG. 2. Furthermore, the watch main body 3 and the clasp 7 are connected to the end piece 10S. The watch main body 3 or the clasp 7 alone may also fill the role of the end piece 10S.

In the configuration described above, the connection of the blocks 10P, Q, X, and Y is a so-called temporary state of connection during the step in which the other ends 15B and 17B of the connecting pin 15 and intermediate pin 17 of the block 10X and block 10P are inserted into the blind holes of the opposing blocks 10Y and Q.

Lastly, the end piece 10S at the very end and the block 10 connected thereto are then connected by the fixing pin 19, and a so-called fixed state is achieved wherein all the blocks 10 cannot come off from the side of the band 5.

When the band 5 is disassembled, first a screwdriver or the like is used to remove the fixing pin 19, and the end piece 10S and the blocks 10 are disconnected.

In this state, the blocks 10Y and Q cannot come off of the other end 17B of the intermediate pin 17, and the problem of blocks 10 coming loose is therefore eliminated even when, for example the band 5 is lifted up while the blocks 10Y and Q in FIG. 3 face downward, because the other end 17B of the intermediate pin 17 connected to one block 10 is inserted into the hole 24 of another block 10, and the other end 17B is held in the hole 24 by the C ring 31.

The clamping force of the C ring 31 is set to about 0.98 to 5.88 N, as described above. Therefore, the blocks 10Y and Q are prevented from being forced to disengage from the other end 17B of the intermediate pin 17 by the weight of one block 10, but the block 10 can still be detached with ease if a slight force is applied in the opposite direction of the arrows X, Y, and Z, as shown in FIG. 3. Thus, the band 5 can be easily disassembled and the length of the band can be adjusted in an extremely simple manner.

Figure 6:
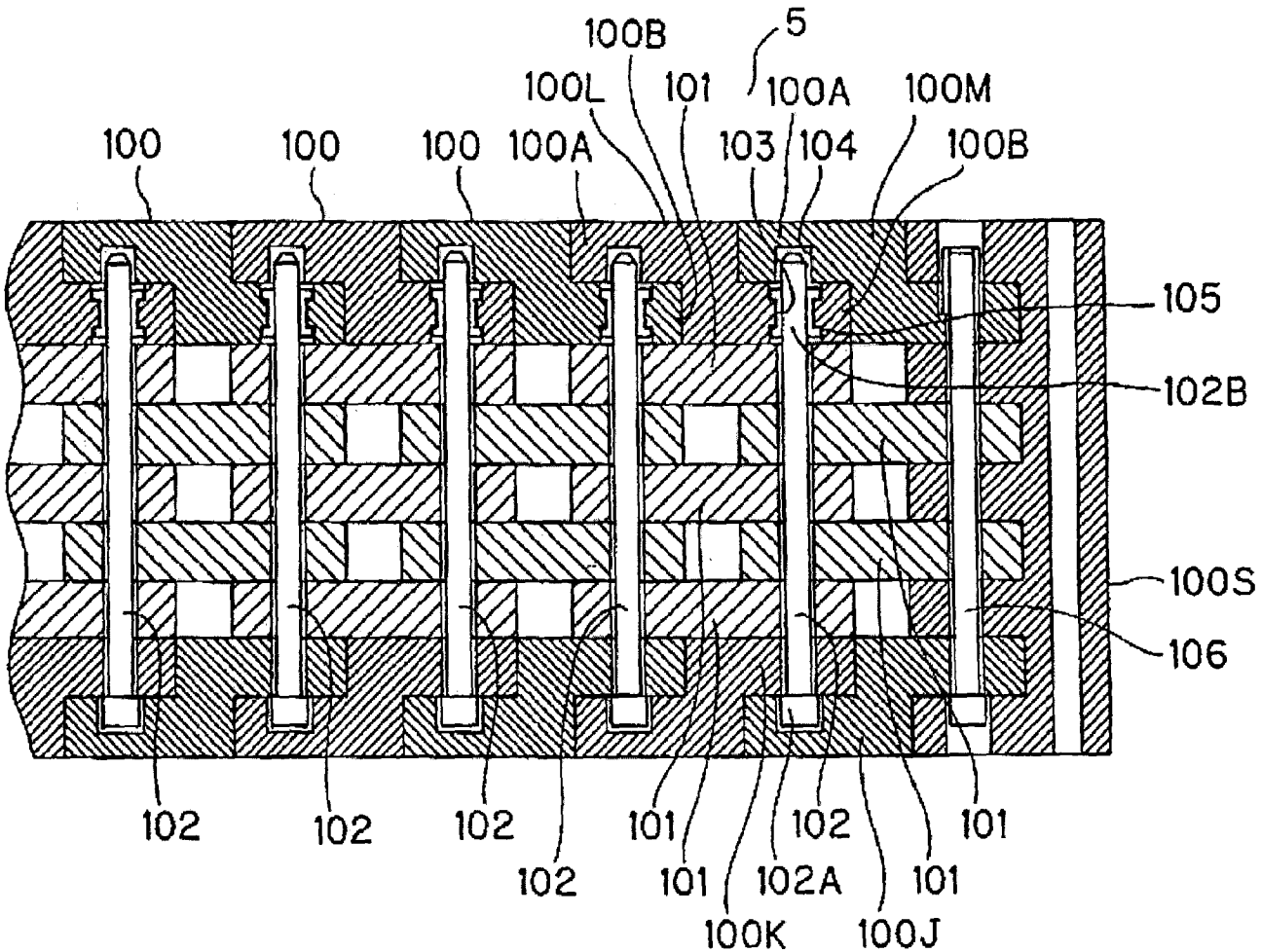
FIG. 6 is a horizontal cross-sectional view of a band showing another embodiment.

FIG. 6 shows another embodiment.

In this embodiment, blocks 100 aligned on both edges of the band 5 are formed integrally without forming a structure divided into an outer block and a middle block, as in the embodiment described above. A holder 100A and a bridge 100B are formed on each block 100, the holder 100A of the block 100 is in contact with the bridge 100B of the block 100, and these blocks 100 are disposed in continuous fashion along the two edges of the band 5.

Also, a plurality of belt-shaped middle blocks 101 is aligned in groups of five at regular intervals in the length direction of the band 5 between the blocks 100 aligned on the edges of the band 5. The plurality of middle blocks 101 and the above-mentioned blocks 100 are then connected to each other via a connecting pin 102. This connecting pin 102 has a head 102A. The connecting pin 102 is connected to one pair of blocks 100J and 100K with the head 102A thereof in a clamped state, and the other end 102B first passes through the plurality of belt-shaped middle blocks 101, then passes through a hole 103 formed in another block 100L, and further extends to be accommodated in a blind hole 104 formed in a block 100M.

All the blocks 100 constituting the necessary band length are connected in the length direction of the band 5, and when this procedure is complete, an end piece 100S is connected to the block 100 on the end of the band 5 by a fixing pin 106. Furthermore, the watch main body 3 and the clasp 7 are connected to the end piece 100S. The watch main body 3 or the clasp 7 alone may also fill the role of the end piece 100S.

In the configuration described above, a C ring (clamping member) 105 for holding the other end 102B of the connecting pin 102 with a specific clamping force is provided to the inner side of the hole (integrated with the blind hole 104) 103 formed in the other block 100L.

The clamping force of the C ring 105 is set at least to a strength at which the other block 100L is not removed by its own weight. The clamping force is generally set at about 0.98 to 5.88 N.

Figure 7:
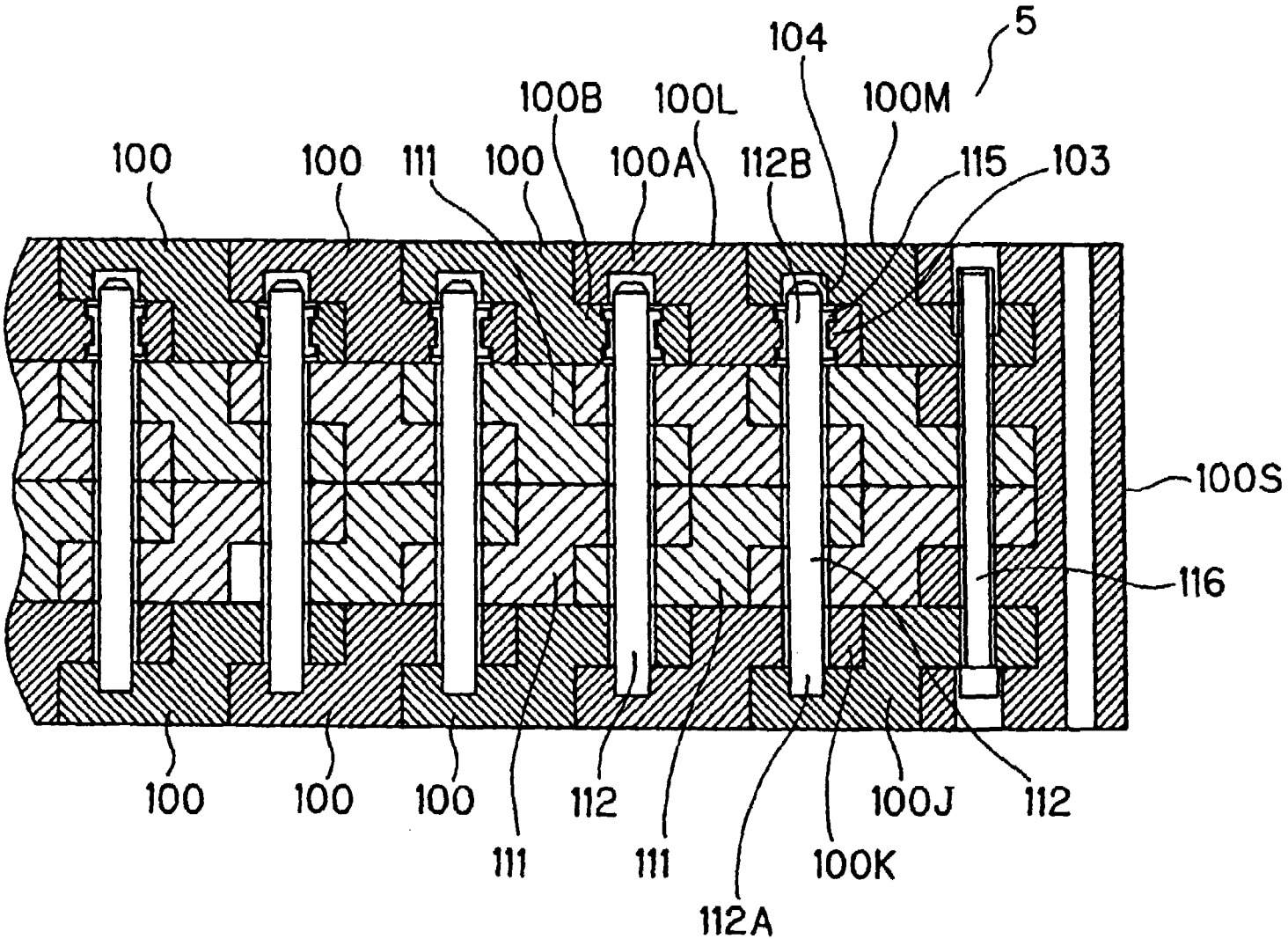
FIG. 7 is a horizontal cross-sectional view of a band showing another embodiment.

FIG. 7 shows yet another embodiment.

In this embodiment, blocks 100 aligned on the edges of the band 5 are formed integrally, similar to the embodiment in FIG. 6. A holder 100A and a bridge 100B are formed on each block 100, the holder 100A of the block 100 is in contact with the bridge 100B of the block 100, and these blocks 100 are disposed in continuous fashion along the two edges of the band 5. A plurality of middle blocks 111 formed in a rough Z-shape are arranged between the blocks 100 aligned on the edges of the band 5. The plurality of middle blocks 111 and the above-mentioned blocks 100 are then connected to each other via a connecting pin 112. One end 112A of the connecting pin 112 is pressed into one block 100J, while the other end 112B first passes through the middle blocks 111, then passes through a hole 103 formed in another block 100L, and further extends to be accommodated in a blind hole 104 formed in a block 100M.

All the blocks 100 constituting the necessary band length are connected in the length direction of the band 5, and when this procedure is complete, an end piece 100S is connected to the block 100 on the end of the band 5 by a fixing pin 116.

In the present embodiment, a C ring (clamping member) 115 for holding the other end 112B of the connecting pin 112 with a specific clamping force is provided to the inner side of the hole (integrated with the blind hole 104) 103 formed in the other block 100L.

The clamping force of the C ring 115 is set at least to a strength at which the other blocks 100L and M are not removed by their own weight. The clamping force is generally set at about 0.98 to 5.88 N.

According to these embodiments, since the other end 112B of the connecting pin 112 is held by the clamping force of the C ring 115, the blocks 100 do not come loose, and the operation of assembling the band 5 or adjusting the length of the band 5 can be performed in an extremely simple manner merely by using tools to release the fixing pin 116, for example.

The present invention was described above on the basis of the embodiments, but the present invention is in no way limited to these embodiments.

In the embodiments described above, the blocks do not come loose, and the operation of assembling the band or adjusting the length of the band can be performed in an extremely simple manner, merely by releasing the fixing pin.

The terms "front," "back, "up," "down," "perpendicular," "horizontal," "slanted," and other direction-related terms used above indicate the directions in the diagrams used herein. Therefore, the direction-related terms used to describe the present invention should be interpreted in relative terms as applied to the diagrams used herein.

"Substantially," "essentially," "about," and other terms used above that represent an approximation indicate a reasonable amount of deviation that does not bring about a considerable change as a result. Terms that represent these approximations should be interpreted so as to include an error of about ±5% at least, as long as there is no considerable change due to the deviation.

The entire disclosure in Japanese Patent Application No. 2003-59787 is incorporated in this specification by reference.

The embodiments described above constitute one part of the embodiments of the present invention, and it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and are only designed to provide a description of the present invention.

What is claimed is:

1. A watchband connected to a watch main body, comprising a first block having a first bridge with a first pinhole, and a clamping member disposed in said first pinhole;

a second block having a holder disposed parallel to said first bridge and provided with a blind hole, and a second bridge with a second pinhole;

a connecting pin extending from said blind hole to said first pinhole and being held with a clamping force by said clamping member;

an end piece being disposed perpendicular to said second bridge; and a fixing pin extending from said second pinhole to said end piece and being designed to connect said second block with said end piece, said first pinhole having a convexity extending towards a center of an inner wall thereof, and said clamping member having a concavity in an outer surface to engage said convexity.

2. The watchband according to claim 1, wherein said clamping force of said clamping member is set to at least a strength at which said connecting pin is not removed by the weight of said second block.

3. The watchband according to claim 2, wherein said clamping member is configured from a C ring.

4. The watchband according to claim 1, further comprising, a middle block disposed between said first block and said second block, wherein said connecting pin extends from said blind hole to said first pinhole and passes through said middle block.

5. A watchband connected to a watch main body comprising:

a first block having a first bridge with a first pinhole;

a second block being disposed parallel to said first block and having a first blind hole and a first clamping member disposed in said first blind hole;

a first intermediate pin extending from said first block to said second block and being held with a clamping force by said first clamping member;

a third block having a second bridge having a second pinhole;

a fourth block being disposed parallel to said third block and having a second blind hole and a second clamping member disposed in said second blind hole;

a second intermediate pin extending from said third block to said fourth block and being held with a clamping force by said second clamping member;

a connecting pin extending from said third block to said fourth block and passing through said first pinhole;

an end piece being disposed perpendicular to said second bridge; and a fixing pin extending from said second pinhole to said end piece and being designed to connect said third block with said end piece, said first pinhole having a first convexity extending towards a center of an inner wall thereof, said first clamping member having a first concavity in an outer surface to engage said first convexity.

6. The watchband according to claim 5, wherein said clamping force of said first clamping member is set to at least a strength at which said first intermediate pin is not removed by the weight of said second block; and said clamping force of said second clamping member is set to at least a strength at which said second intermediate pin is not removed by the weight of said fourth block.

7. The watchband according to claim 6, wherein said first and second clamping members are configured from a C ring.

8. The watchband according to claim 7, wherein said second pinhole has a second convexity extending towards a center of an inner wall thereof, and said second clamping member has a second concavity in an outer surface to engage said second convexity.

9. The watchband according to claim 7, wherein said fourth block has a hole for said connecting pin, and one end of said connecting pin is fixed to said third block, and the other end is inserted in said hole for said connecting pin.

10. A watch comprising:

a first block having a first bridge with a first pinhole, and a clamping member disposed in said first pinhole;

a second block having a holder being disposed parallel to said first bridge and having a blind hole, and a second bridge having a second pinhole;

a connecting pin extending from said blind hole to said first pinhole and being held with a clamping force by said clamping member;

an end piece being disposed perpendicular to said second bridge;

a fixing pin extending from said second pinhole to said end piece and being designed to connect said second block with said end piece; and a watch main body being connected to said end piece, said first pinhole having a convexity extending towards a center of an inner wall thereof, and said clamping member having a concavity in an outer surface to engage said convexity.

11. The watch according to claim 10, wherein said clamping force of said clamping member is set to at least a strength at which said connecting pin is not removed by the weight of said second block.

12. The watch according to claim 11, wherein said clamping member is configured from a C ring.

13. The watch according to claim 10, further comprising, a middle block disposed between said first block and said second block, wherein said connecting pin extends from said blind hole to said first pinhole and passes through said middle block.

14. A watch comprising:

a first block having a first bridge with a first pinhole;

a second block being disposed parallel to said first block and having a first blind hole and a first clamping member disposed in said first blind hole;

a first intermediate pin extending from said first block to said second block and being held with a clamping force by said first clamping member;

a third block having a second bridge with a second pinhole;

a fourth block being disposed parallel to said third block and having a second blind hole and a second clamping member disposed in said second blind hole;

a second intermediate pin extending from said third block to said fourth block and being held with a clamping force by said second clamping member;

a connecting pin extending from said third block to said fourth block and passing through said first pinhole;

an end piece being disposed perpendicular to said second bridge;

a fixing pin extending from said second pinhole to said end piece and being designed to connect said third block with said end piece; and a watch main body being connected to said end piece, said first pinhole having a first convexity extending towards a center of said inner wall thereof, said first clamping member having a first concavity in an outer surface to engage said first convexity.

15. The watch according to claim 14, wherein said clamping force of said first clamping member is set to at least a strength at which said first intermediate pin is not removed by the weight of said second block, and said clamping force of said second clamping member is set to at least a strength at which said second intermediate pin is not removed by the weight of said fourth block.

16. The watch according to claim 15, wherein said first and second clamping members are configured from a C ring.

17. The watch according to claim 16, wherein said second pinhole has a second convexity extending towards a center of an inner wall thereof, and said second clamping member has a second concavity in an outer surface to engage said second convexity.

18. A watch comprising:

a first block having a first bridge with a first pinhole;

a second block being disposed parallel to said first block and having a first blind hole and a first clamping member disposed in said first blind hole;

a first intermediate pin extending from said first block to said second block and being held with a clamping force by said first clamping member;

a third block having a second bridge with a second pinhole;

a fourth block being disposed parallel to said third block and having a second blind hole and a second clamping member disposed in said second blind hole;

a second intermediate pin extending from said third block to said fourth block and being held with a clamping force by said second clamping member;

a connecting pin extending from said third block to said fourth block and passing through said first pinhole;

an end piece being disposed perpendicular to said second bridge;

a fixing pin extending from said second pinhole to said end piece and being designed to connect said third block with said end piece; and a watch main body being connected to said end piece, said fourth block having a hole for said connecting pin, and one end of said connecting pin being fixed to said third block, and the other end being inserted in said hole for said connecting pin.

* * * * *